US005108030A

United States Patent [19]

Schuster et al.

[11] Patent Number: 5,108,030

[45] Date of Patent: Apr. 28, 1992

[54] SLEEVE-TYPE ARTICLE CARRIER

[75] Inventors: Richard L. Schuster, Monroe; Jerry F. Wilson, Downsville, both of La.

[73] Assignee: Riverwood International Corporation, Denver, Colo.

[21] Appl. No.: 720,350

[22] Filed: Jun. 25, 1991

[51] Int. Cl.[5] ..... B65D 5/06

[52] U.S. Cl. ..... 229/132; 206/427; 229/40

[58] Field of Search ..... 229/40, 132, 136; 206/427

[56] References Cited

U.S. PATENT DOCUMENTS

| | | | |
|---|---|---|---|
| 3,194,473 | 7/1965 | Rumberger | 229/132 |
| 3,285,492 | 11/1966 | Demby et al. | 229/132 |
| 3,951,332 | 4/1976 | Torbeck | 229/132 |
| 4,084,693 | 4/1978 | Culpepper | 229/40 |
| 4,295,598 | 10/1981 | Calvert | 229/40 |
| 4,588,084 | 5/1986 | Holley, Jr. | 229/40 |
| 4,915,292 | 4/1990 | Ielmini | 229/132 |

FOREIGN PATENT DOCUMENTS

| | | | |
|---|---|---|---|
| 1311273 | 10/1962 | France | 229/1332 |

*Primary Examiner*—Gary E. Elkins
*Attorney, Agent, or Firm*—Cornelius P. Quinn

[57] ABSTRACT

A sleeve-type article carrier and a blank for forming the same. The end panels of the carrier comprise overlapping end flaps which overlie dust flaps such that a single stripe of adhesive can be used to adhere the overlapping end flap to the overlapped end flap and to the underlying dust flaps. The end flaps and dust flaps are dimensioned so that the blank can be die cut from a web of no greater width than is used in producing blanks of conventional design.

3 Claims, 3 Drawing Sheets

SLEEVE-TYPE ARTICLE CARRIER

FIELD OF THE INVENTION

This invention relates to a sleeve-type article carrier. More particularly, it relates to a sleeve-type article carrier having end panels formed from glued end flaps and dust flaps.

BACKGROUND OF THE INVENTION

Sleeve-type article carriers are formed from a blank which typically comprises spaced side panel sections connected on one side to an interior panel section which forms either the top or bottom panel of the carrier, and on the other side to outer panel sections which when connected together form the other top or bottom panel. When the outer panel sections are connected, as by adhesive, the result is a sleeve which can be filled from either open end. To close the ends of the carrier after the carrier sleeve has been filled with the articles to be packaged, the dust flaps are folded in and the end flaps are then folded so as to overlie and contact the dust flaps. Adhesive applied to the end flaps adheres the end flaps to the dust flaps, thereby holding the flaps in place to form the end panels.

This procedure, while effectively forming the end panels, nonetheless has certain disadvantages. Carrier sleeves are conventionally moved through the packaging machine with one of the side panels resting on a moving conveyor so that the open ends of the sleeves face to the side. Articles are then fed into the sleeve from one or both sides through the open ends. The need to apply adhesive to both of the end flaps in each end panel thus requires two sets of adhesive spray nozzles or other adhesive applicator means to be provided on each side of the packaging line. This causes the area to be more congested with equipment than is desirable and also requires the adhesive application operation for both flaps to be more precisely timed than would be preferred at high operating speeds. In addition, the need for dual adhesive applicators on each side of the packaging line increases maintenance requirements.

It would be desirable to reduce the number of adhesive applicators without reducing the effectiveness and efficiency of the packaging operation and without adversely affecting the strength and integrity of the end panels of the carriers. To do so, however, would appear to require a basic redesign of the package and possibly a substantial redesign of the adhesive application section of the packaging machine as well. This would not be acceptable since existing machines would have to be significantly modified in order to run the new package design. Additionally, any redesign of the carrier should not result in the usage of more paperboard since this would increase the cost of the carrier and possibly negate the benefits of the new design. In view of these considerations, it would not appear that the objective of reducing the number of adhesive applicators could be achieved without introducing other major problems.

SUMMARY OF THE INVENTION

This invention provides a new carrier design which achieves the stated goals. In accordance with the invention, the conventional sleeve-type carrier design has been left intact, with changes made only to the flaps forming the end panels. End flaps are connected to each associated end edge of the side panels along fold lines and dust flaps are connected to each associated end edge of each of the top and bottom panels. The dust flaps are spaced from each other, and both of the end flaps overlie at least portions of the dust flaps. One of the end flaps overlaps a portion of the other end flap and is adhered to the other end flap and to underlying portions of the dust flaps by adhesive. The width of the end portion of the overlapping end flap is thus greater than the width of the overlapped portion of the other end flap.

Preferably, the adhesive adhering the overlapping portions of the end flaps to each other and to underlying portions of the dust flaps extends along a linear path for substantially the full width of the overlying flap portion.

The blank has been designed so as to produce a carrier as described without adding to its overall width. In accordance with the invention, the flaps are dimensioned such that when two identical blanks are positioned side by side so that the end edge of one of the end flaps of one of the blanks is adjacent the end edge of the dust flap connected to the inner panel section of the other blank, the overlapping end flap in the carrier does not overlap the dust flaps of the other blank. Both end flaps on the same side of a blank are wider at the fold line connecting them to the side panel sections than at their end edges.

Preferably, the length of each end flap as measured from the fold line connecting the end flap to the adjacent side panel section is substantially the same, and the length of each dust flap as measured from the fold line connecting the dust flap to the adjacent inner or outer panel section is substantially the same. Also, the blank preferably is dimensioned so that the end edges of the dust flaps facing an adjacent identical blank contact the end edges of the facing adjacent end flaps thereof.

This arrangement allows the same number of blank widths to be cut from the same width of web stock as was done with the previous carrier design, yet enables end panels to be formed from overlapping end flaps as opposed to the conventional design wherein the end flap edges are adjacent each other but are not overlapped. This in turn requires adhesive to be applied only to the overlapping end flap and not to both end flaps as previously was the case, thus eliminating the need for one of the glue nozzles and accessory equipment on each side of the packaging line.

The features of the invention which enable it to provide the desired results are brought out in more detail below in connection with the description of the preferred embodiment, wherein the above and other aspects of the invention, as well as other benefits, will readily be apparent.

DETAILED DESCRIPTION OF THE PREFERRED EMBODIMENT

Figure 1:
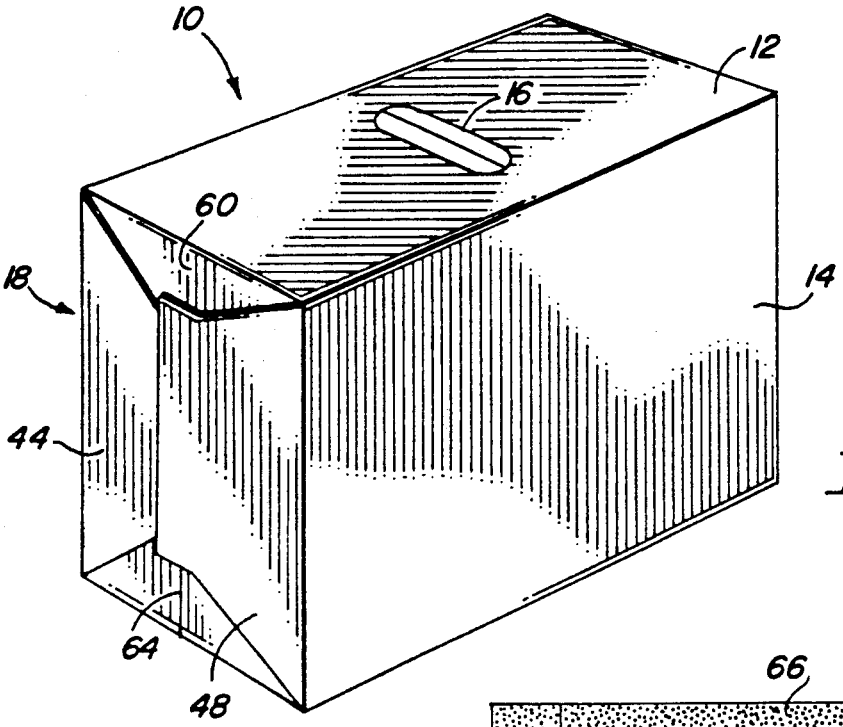
FIG. 1 is a pictorial view of a sleeve-type carrier incorporating the features of the present invention.

Referring to FIG. 1, the carrier 10 is comprised of a top panel 12, side panels 14 and a bottom panel, not visible in this view. The top panel includes a handle opening 16. The carrier also includes end panels 18 which embody the main features of the invention and which are comprised of end flaps 44 and 48 and dust flaps 60 and 64. The specific arrangement of the flaps forming the end panels are described in more detail below.

Figure 2:
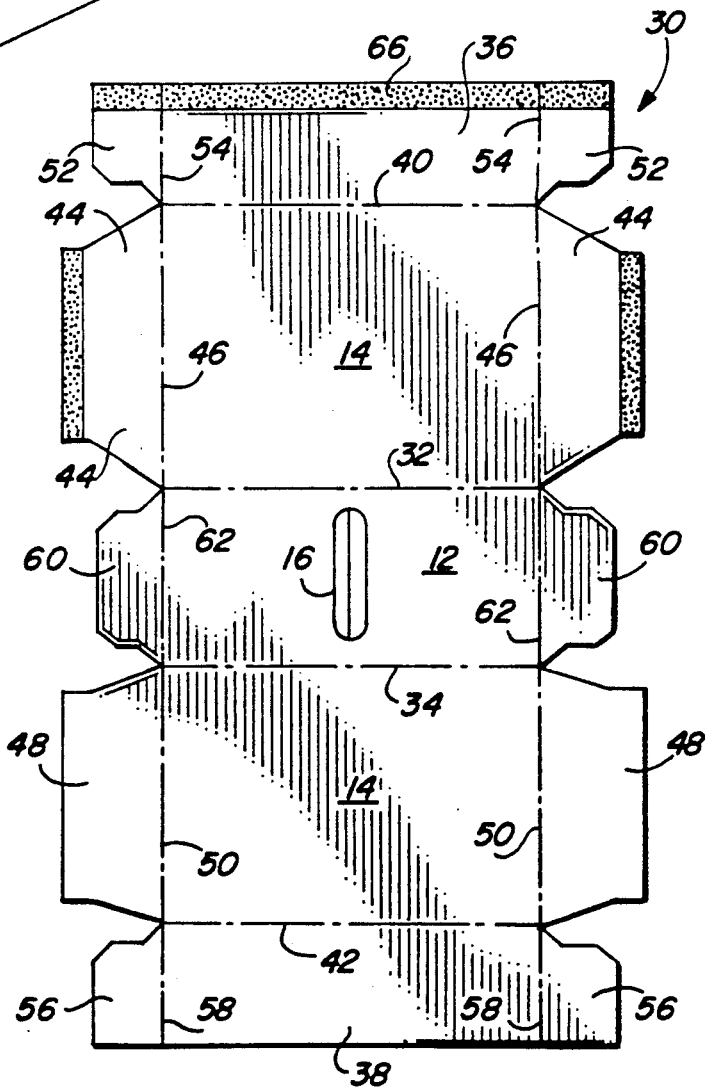
FIG. 2 is a plan view of a production blank for forming the carrier of FIG. 1.

A production blank for forming the carrier of FIG. 1 is indicated generally by reference numeral 30 in FIG. 2, wherein like reference numerals to those used in FIG. 1 refer to the portions of the blank which form corresponding elements of the carrier. The blank is substantially rectangular in shape and comprises a central section 12 connected to side panel sections 14 by fold lines 32 and 34. The side panel sections 14 are also connected to outer panel sections 36 and 38 by fold lines 40 and 42, respectively. The fold lines 32, 34, 40 and 42 correspond to the side edges of the top, side and bottom panels of the carrier.

A number of flaps are also connected to the panel sections along fold lines corresponding to the end edges of the carrier panels. End flaps 44 are connected to the end edges of one of the side panel sections 14 along fold lines 46, while end flaps 48 are connected to the end edges of the other side panel section 14 along fold lines 50. Dust flaps 52 are connected to the end edges of the outer section 36 along fold lines 54, and dust flaps 56 are connected to the end edges of the other outer section 38 along fold lines 58. In addition, dust flaps 60 are connected to the end edges of the central panel 12 along fold lines 62.

To form the carrier of FIG. 1, adhesive is applied to one of the outer panel sections and connected dust flaps as indicated by the stippled area 66 which extends along the outer edge portion of panel section 36 and the dust flaps 52. By folding the blank about the fold line 32, the adhesive stripe contacts the outer edge portion of the other outer panel section 38 and associated dust flaps 56 to form a flat or collapsed carrier sleeve. The blanks are typically introduced to packaging machines in collapsed form, where they are then opened into the open-ended sleeve form shown in FIG. 3. As illustrated, the panel formed by the adhered outer blank sections 36 and 38 is the bottom panel of the carrier, while the central panel section 12 is the top panel. It will be understood that this arrangement could be reversed by providing the handle in the combined panel 36, 38, in which case that panel would be the top panel and the panel 12 would be the bottom panel of the carrier.

Figure 3:
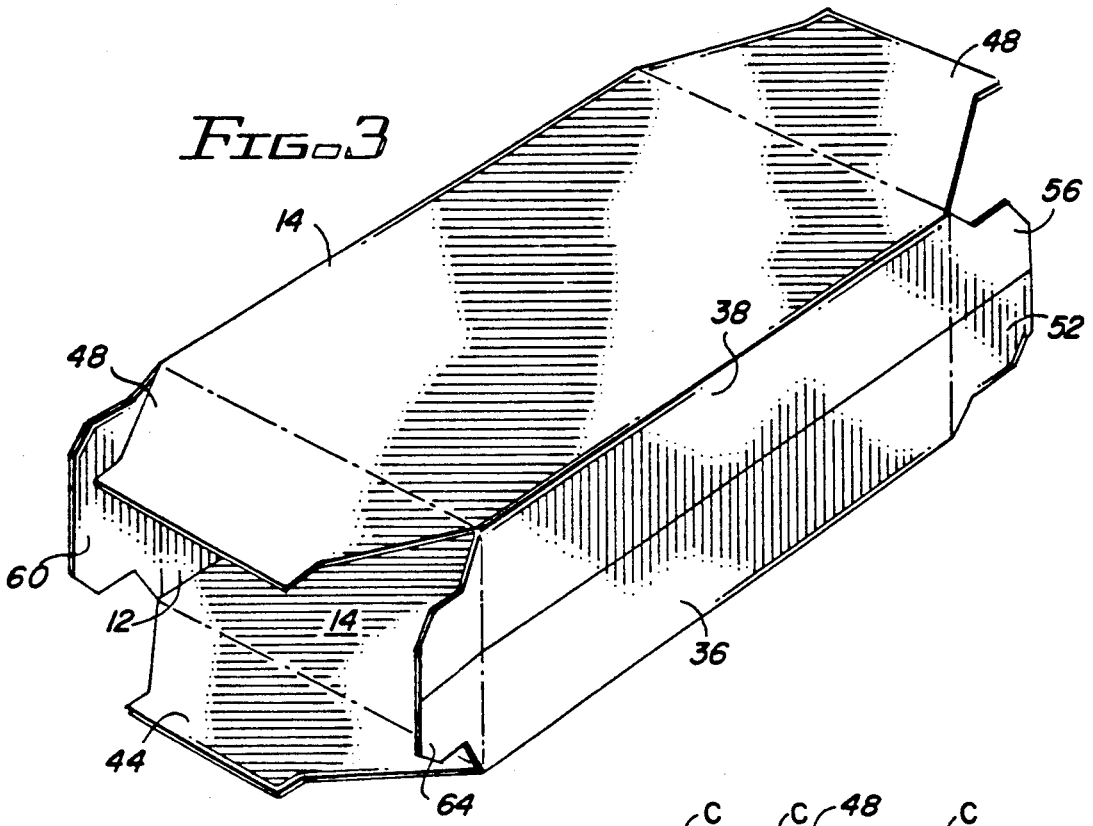
FIG. 3 is a pictorial view of an open-ended carrier sleeve formed from the blank of FIG. 2.
Figure 4:
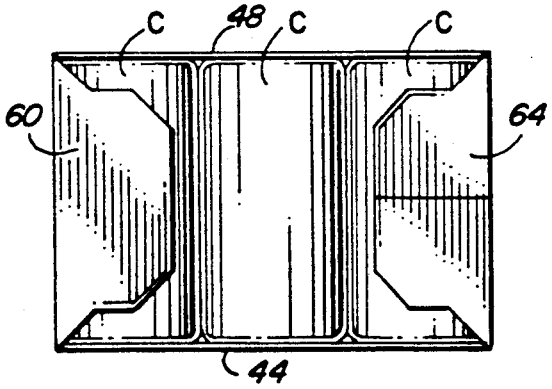
FIG. 4 is an end view of the sleeve of FIG. 3, shown after the dust flaps have been folded into place.

In practice, articles to be packaged are inserted into the open sleeve of FIG. 3 while the sleeve is being conveyed through a packaging machine. The flaps 44, 48, 60 and the combined flap 64 formed from the flaps 52 and 56 are accordingly shown extending from their associated panels in open unfolded condition. Referring to FIG. 4, articles such as beverage cans C are shown in place after having been loaded into the sleeve. The end flaps 44 and 48 are still in open condition, but the dust flaps 60 and 64 have been folded in toward each other as the first step in forming the end panel.

Figure 5:
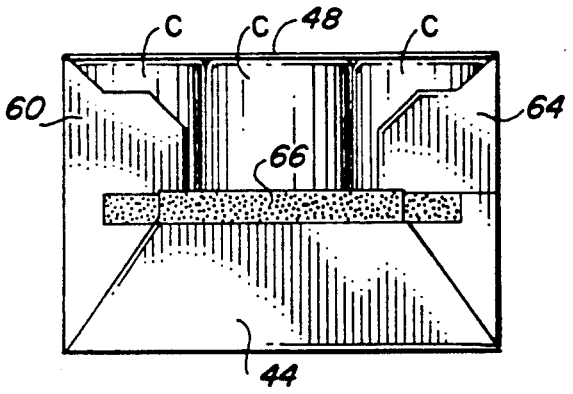
FIG. 5 is an end view similar to that of FIG. 4, after the overlapped end flap has been folded into place.

The next step is illustrated in FIG. 5, which shows the end flap 44 in folded position, with the side edge portions of the flap 44 overlapping portions of the dust flaps. The end flap 48 is still in open position at this point. Prior to folding the flap 48 down so as to overlap the end portion of the flap 44, adhesive is applied to either the flap 48 or to the stippled area 66 on the flap 44 and on portions of the dust flaps 60 and 64 corresponding to the portions which will be engaged by the flap 48. The flap 48 is then folded down to the position shown in FIG. 6, whereby the outer end portion of the flap 48 overlaps the end portion of the flap 44 and portions of the dust flaps 60 and 64.

Each end panel is thus formed by the end flap 44 overlapping portions of the dust flaps 60 and 64, and the end flap 48 overlapping other portions of the dust flaps as well as portions of the end flap 44. The entire end panel is securely held in place by a single line or stripe of adhesive corresponding to the areas of engagement of the outer end portion of the flap 48 with the end flap 44 and the dust flaps 60 and 64. This contrasts with the conventional arrangement in which both end flaps meet or abut at their outer ends and are each adhered to the underlying dust flaps by separate adhesive stripes.

Figure 6:
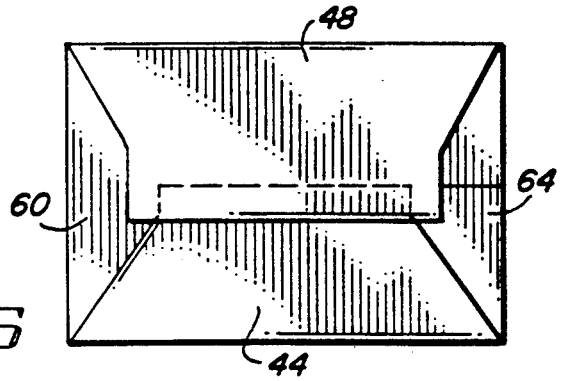
FIG. 6 is an end view similar to that of FIG. 5, showing the overlapping end flap folded and adhered to the underlying flaps.

As illustrated in FIG. 6, in order to provide their desired functions the width of the end portion of the overlapped end flap 44 must be narrower than the width of the overlapping end flap 48. The widths of both the end flaps 44 and 48, moreover, must be great enough to overlap portions of the dust flaps 60 and 64. Further, the lengths of the dust flaps 44 and 48, as measured from the fold lines connecting them to their associated side panels, are greater than the lengths of the prior art end flaps that extend out from their fold lines only a distance sufficient to meet each other. A blank having flaps that meet these dimensional relationships would appear to require a greater width than conventional blanks, which in turn would require more stock. According to the invention, however, the end panel flaps can be provided on a blank of the same width as prior art blanks.

Figure 7:
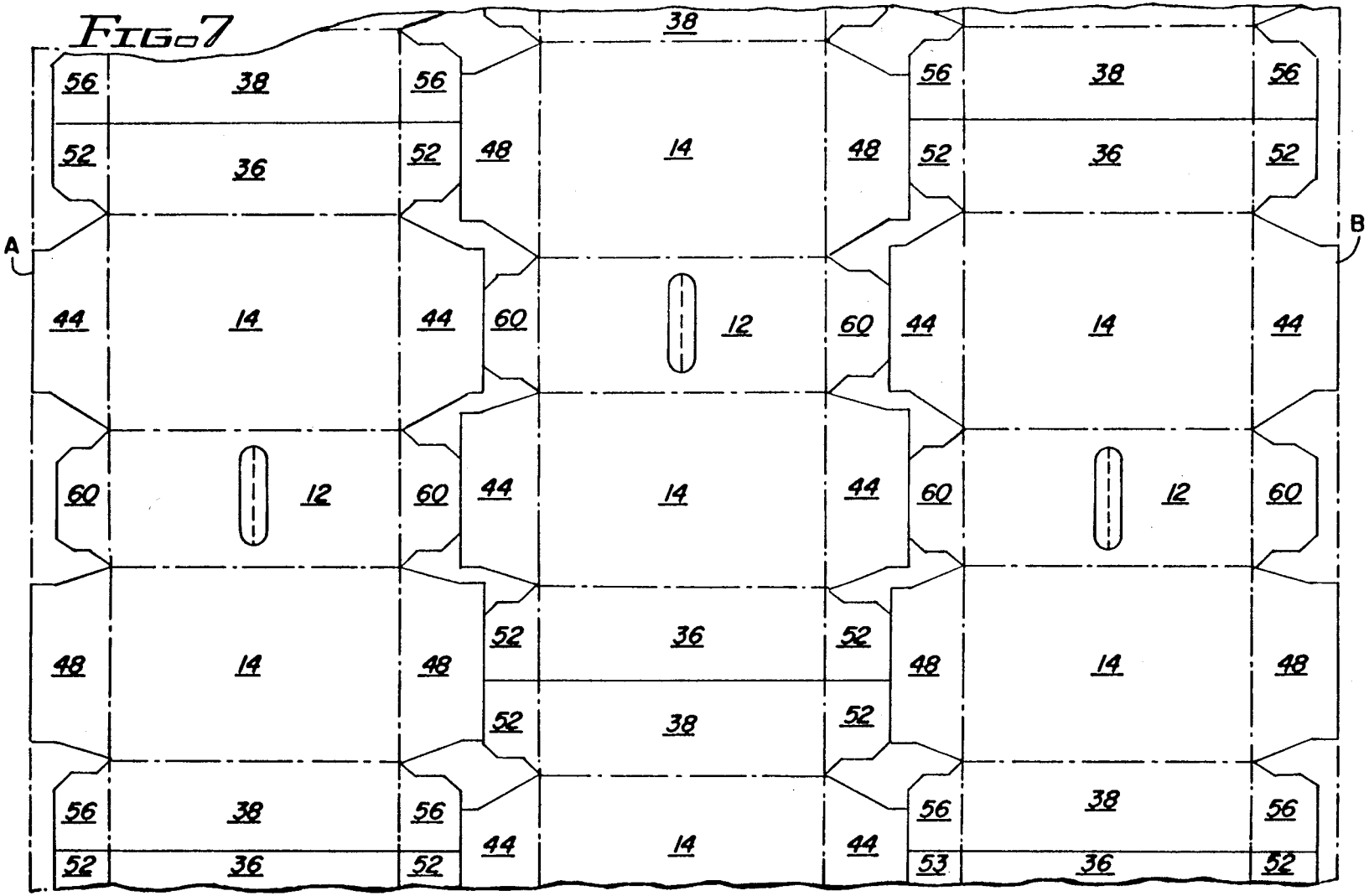
FIG. 7 is a plan view of three rows of carrier blanks, illustrating their spatial relationship upon being cut from a web of stock material.

Referring to FIG. 7, three rows of blanks are shown as they would appear upon being die-cut from a web of stock material. Because the blanks are identical, the same reference numerals have been used for the components of each. As can be seen, the blanks are arranged so that the ends of the dust flaps 60 of one blank abut the ends of the end flaps 44 of the adjacent blank, and the ends of both adjacent dust flaps 52 and 56 abut the ends of the end flaps 48. Thus the blanks in each row are inverted with respect to the blanks in adjacent rows and the leading and trailing ends of the blanks are offset from the leading and trailing ends of the adjacent blanks in adjacent rows. The end flaps 44, which are designed to be overlapped by the end flaps 48 in the end panel of a carrier, are considerably wider at their base than at their free ends. This shape allows the end flaps 44 to extend all the way to the dust flaps 60 in the adjacent row while still remaining spaced from the end flaps 48 in the adjacent row. This is of particular importance since the end flaps 44 and 48 extend from their fold lines a considerably greater distance than do the end flaps of conventional carrier blanks in order to provide for overlapping of the flaps as opposed to the abutting flaps in the conventional prior art arrangement. It will be noted that the flaps 48 must remain relatively wide in order to overlap the dust flaps and the flaps 44 in the end panel of a carrier, which makes the strongly tapered configuration of end flaps 44 essential.

Even with the presence of relatively long end flaps 44 and 48 as opposed to the shorter end flaps of conventional designs, the overall width of the web from which the blanks are cut need not be greater than the width of the web from which conventional carrier blanks are cut. For example, in the typical arrangement shown in FIG. 7, whereby three rows of blanks are cut from one web of stock material, the maximum distance across the web as measured from point A to point B includes three main panels 14, 12 and 14, two dust flaps 60 and four end flaps 44. In a preferred example, for a carrier designed to carry twelve beverage cans, the main panels are 10 ⅜ inches across the width of the blank, the dust flaps measure 1 11/16 inches and the end flaps measure 2 ⅝ inches. The distance from point A to point B is thus 45 inches.

In the conventional prior art design, the main panels are also 10 ⅜ inches, but the end flaps measure 2 5/16 inches. Because of the relatively uniform width of the end flaps, portions of the end flaps of adjacent blanks in adjacent rows abut. This means that a web comprised of a three-wide blank arrangement would be made up of three main panel widths and six end flap widths, which at the conventional dimensions given above totals 45 inches. Thus, even though the end flaps of the carrier blanks of the invention are longer than the end flaps of conventional carrier blanks, the abutting relationship of the prior art blanks requires the same width web as the web used to produce the blanks of the present invention.

It should now be apparent that because the invention enables only a single stripe of adhesive to be used in adhering the end flaps and dust flaps together when forming the end panels of a carrier, the packaging operation is facilitated and adhesive usage is reduced. The overlapping flap arrangement, as opposed to an abutting arrangement, also allows more margin for error in aligning the end flaps to maintain continuity of appearance when the flaps are imprinted with a design or writing. Further, this is achieved without having to use a wider web of stock material from which the carrier blanks are cut, as would appear to be necessary.

It should now be appreciated after reading the foregoing description that the invention need not necessarily be limited to all the specific details described in connection with the preferred embodiment, but that changes to certain features which do not alter the overall basic function and concept of the invention may be made without departing from the spirit and scope of the invention defined in the claims.

What is claimed is:

1. In a generally rectangular article carrier blank having an inner panel section, two outer panel sections and two intermediate side panel sections, each panel section having side and end edges, the side edges of the intermediate side panel sections being connected along fold lines to the side edges of the inner panel section and to adjacent side edges of the outer panel sections, the outer panel sections being adapted to be connected to form a top or bottom panel of a carrier formed from the blank and the inner panel section forming the other top or bottom panel of such a carrier, the blank further including end flaps connected along fold lines to the end edges of the side panel sections and dust flaps connected along fold lines to the end edges of the inner and outer panel sections, the end flaps and the dust flaps being adapted to be connected to form end panels of the carrier, the improvement comprising:

one of the end flaps adapted to form part of one of the end panels having a length such that the end flap overlaps the other associated end flap in the end panel of a carrier formed from the blank;

both said one end flap and said other end flap having widths such that they overlie at least portions of the associated dust flaps in such a carrier;

said one end flap being adapted to be adhered to the other end flap and to underlying portions of the dust flaps in said end panel by adhesive;

the portion of said one end flap which overlaps the other associated flap in a carrier formed from the blank having a width, as measured in a direction substantially parallel to the end edge of the side panel sections, greater than the width of the portion of the other end flap which is overlapped in such a carrier;

said blank being capable of being positioned in side by side abutting relationship with a second identical blank so that the end edge of one of the end flaps of said one blank is adjacent the end edge of the dust flap connected to the inner panel section of the second blank and said one end flap of said one blank does not overlap the adjacent dust flap of the second blank; and both end flaps on the same side of the blank being wider at the fold line connecting them to the side panel sections than at their end edges.

2. The carrier blank of claim 1, wherein the length of each end flap as measured form the fold line connecting the end flap to the adjacent side panel section is substantially the same, and the length of each dust flap as measured from the fold line connecting the dust flap to the adjacent inner or outer panel section is substantially the same.

3. The carrier blank of claim 1, wherein the blank is dimensioned so that the end edges of the dust flaps facing a second adjacent identical blank contact the end edges of the facing adjacent end flaps thereof.

* * * * *